US005673501A

United States Patent [19]

Mathews

[11] Patent Number: 5,673,501

[45] Date of Patent: Oct. 7, 1997

[54] NOVELTY SHOE WITH DETACHABLE ORNAMENTAL ARTICLE

[75] Inventor: John G. Mathews, Providence, R.I.

[73] Assignee: SRL, Inc., Wilmington, Del.

[21] Appl. No.: 619,264

[22] Filed: Mar. 18, 1996

Related U.S. Application Data

[63] Continuation of Ser. No. 379,162, Jan. 27, 1995, abandoned.

[51] Int. Cl.[6] ..... A43B 23/00; A43B 3/28

[52] U.S. Cl. ..... 36/136; 36/112

[58] Field of Search ..... 36/132, 136, 45, 36/112, 1; 40/636; 63/1.1, 2

[56] References Cited

U.S. PATENT DOCUMENTS

| | | | |
|---|---|---|---|
| 2,693,014 | 11/1954 | Monahan . | |
| 2,946,305 | 7/1960 | Hill . | |
| 3,114,982 | 12/1963 | McGowan . | |
| 4,527,760 | 7/1985 | Salacuse | 24/590 X |
| 4,698,921 | 10/1987 | Townsend | 36/136 X |
| 4,712,319 | 12/1987 | Goria | 36/137 |
| 4,724,628 | 2/1988 | Schreiner | 36/132 X |
| 4,837,960 | 6/1989 | Skaja | 36/136 X |
| 5,094,580 | 3/1992 | Abe | 24/590 X |
| 5,136,726 | 8/1992 | Kellin et al. | 2/244 |
| 5,456,032 | 10/1995 | Matsumoto et al. | 36/136 X |

*Primary Examiner*—B. Dayoan
*Attorney, Agent, or Firm*—Fish & Richardson P.C.

[57] ABSTRACT

An article of footwear includes a shoe with a sole and upper, a toy element, and a snap attachment assembly consisting of cooperating male and female components. The female component is attached to the shoe. The cooperating male component is attached to the ornamental article, which is thus removably assembled with the shoe by cooperative, snap engagement of the female and cooperating male components of the snap attachment assembly. In preferred embodiments, one or several ornamental articles are interchangeably displayed on shoes and on fashion display accessories, e.g., bracelets, barrettes, chains and pendants.

9 Claims, 3 Drawing Sheets

NOVELTY SHOE WITH DETACHABLE ORNAMENTAL ARTICLE

This is a continuation of application Ser. No. 08/379,162, filed Jan. 27, 1995, now abandoned.

BACKGROUND OF THE INVENTION

The invention relates to novelty shoes, especially for children.

Shoes are fashioned to provide comfort and support, as well as to be aesthetically pleasing to the eye. For example, logos, stylized designs and decorative marks are often placed on the outer surfaces of the shoe.

Lights and sound-emitting devices have also been fixedly attached to or molded within a shoe to be sportive or amusing.

It has been known to attach display and other articles to the surface of shoe uppers. For example, Skaja U.S. Pat. No. 4,837,960 shows identification elements attached to a shoe by engagement of a peripheral mounting rib in a corresponding circumferential groove in the identification element. Skaja also mentions attachment of articles by means of VELCRO® hook-and-loop type fasteners, e.g. as shown in Kellin et al. U.S. Pat. No. 5,136,726. Goria U.S. Pat. No. 4,712,319 describes shoes with detachable visibility aids held in place by spaced mounting appendages grasping the edge of a flange at the rear of the visibility aid. McGowan U.S. Pat. No. 3,114,982 describes an athletic shoe with weights in a removable case attached to the shoe upper with releasable snaps.

SUMMARY OF THE INVENTION

According to one aspect of the invention, an article of footwear comprises a shoe having a sole and an upper mounted on the sole, an ornamental article, and a snap attachment assembly comprising a female component fixedly secured to the upper of the shoe, the female component comprising a body portion formed of a resilient material and defining an attachment aperture, and an elongated cooperating male component having a body portion mounted to extend from a rear surface of the ornamental article and terminating in a tip portion spaced from the rear surface, the elongated cooperating male component sized for releasable snap fit engagement with, and disengagement from, the attachment aperture defined by the female component by application of axially directed force.

Preferred embodiments of this aspect of the invention may also include one or more of the following additional features. The elongated cooperating male component has a first diameter in the region of the tip portion and a second diameter relatively less than the first diameter in a region of the body portion relatively closer to the rear surface, and the attachment aperture defined by the female component of the snap attachment assembly comprises a through aperture with a first aperture portion having a third diameter selected for interference engagement with the tip portion of the second diameter, a second aperture portion having a fourth diameter greater than the second diameter of the tip portion, and a circumferential lip interface between the first aperture portion and the second aperture portion. Preferably, the first and second aperture portions and the lip are concentric. Also, the upper comprises an outer layer defining a display aperture, and the body portion of the female component of the snap attachment assembly comprises a disc-shaped member extending beneath the outer layer, with the attachment aperture exposed within the display aperture. Preferably, the female component of the snap attachment assembly is secured, with the disc-shaped member extending beneath the outer layer and the attachment aperture exposed within the display aperture, by stitching to the upper. The body portion of the female component of the snap attachment assembly further comprises a display member mounted upon the disc-shaped member and extending into the display aperture, the display member and the display aperture having predetermined complementary shapes.

According to another aspect of the invention, an ornamental article and display assembly comprises a shoe including a sole and an upper mounted on the sole, a plurality of ornamental articles, a fashion display accessory, and a snap attachment assembly comprising a first female component fixedly secured to the upper of the shoe, the first female component having a body formed of a resilient material and defining an attachment aperture, a second female component associated with the fashion display accessory, the second female component having a body formed of a resilient material and defining an attachment aperture, and an elongated cooperating male component having a body portion mounted to extend from a rear surface of the ornamental article and terminating in tip portion spaced from the rear surface, the elongated cooperating male component sized for releasable snap fit engagement with, and disengagement from, the attachment aperture defined by the first and second female components by application of axially directed force, whereby ornamental articles removably attached to the shoe and to fashion display accessory by cooperative engagement of the male and female components of the snap attachment assembly are interchangeable.

Preferred embodiments of this aspect of the invention may include one or more of the following additional features. The elongated cooperating male component has a first diameter in the region of the tip portion and a second diameter relatively less than the first diameter in a region of the body portion relatively closer to the rear surface, and the attachment aperture defined by the female component of the snap attachment assembly comprises a through aperture with a first aperture portion having a third diameter selected for interference engagement with the tip portion of the male component, a second aperture portion having a fourth diameter greater than the second diameter of the tip portion, and a circumferential lip interface between the first aperture portion and the second aperture portion. The fashion display accessory comprises a pendant and chain, a barrette or a bracelet. The fashion display accessory defines a plurality of display apertures.

Objectives of the invention include providing a structure for releasable attachment of display articles upon the surface of a shoe upper, and in particular upon the surface of children's shoes, the structure resisting dislodgement of the display articles during normal activities of running and jumping, but allowing easy removal of the display article by a child applying axial force. A further objective is to provide a set of display articles and complementary fashion accessories, the display articles being interchangeably displayed on the shoe and the fashion display accessories.

These and other features and advantages of the invention will be apparent from the following description of a presently preferred embodiment, and from the claims.

DESCRIPTION OF THE PREFERRED EMBODIMENTS

Figure 1:
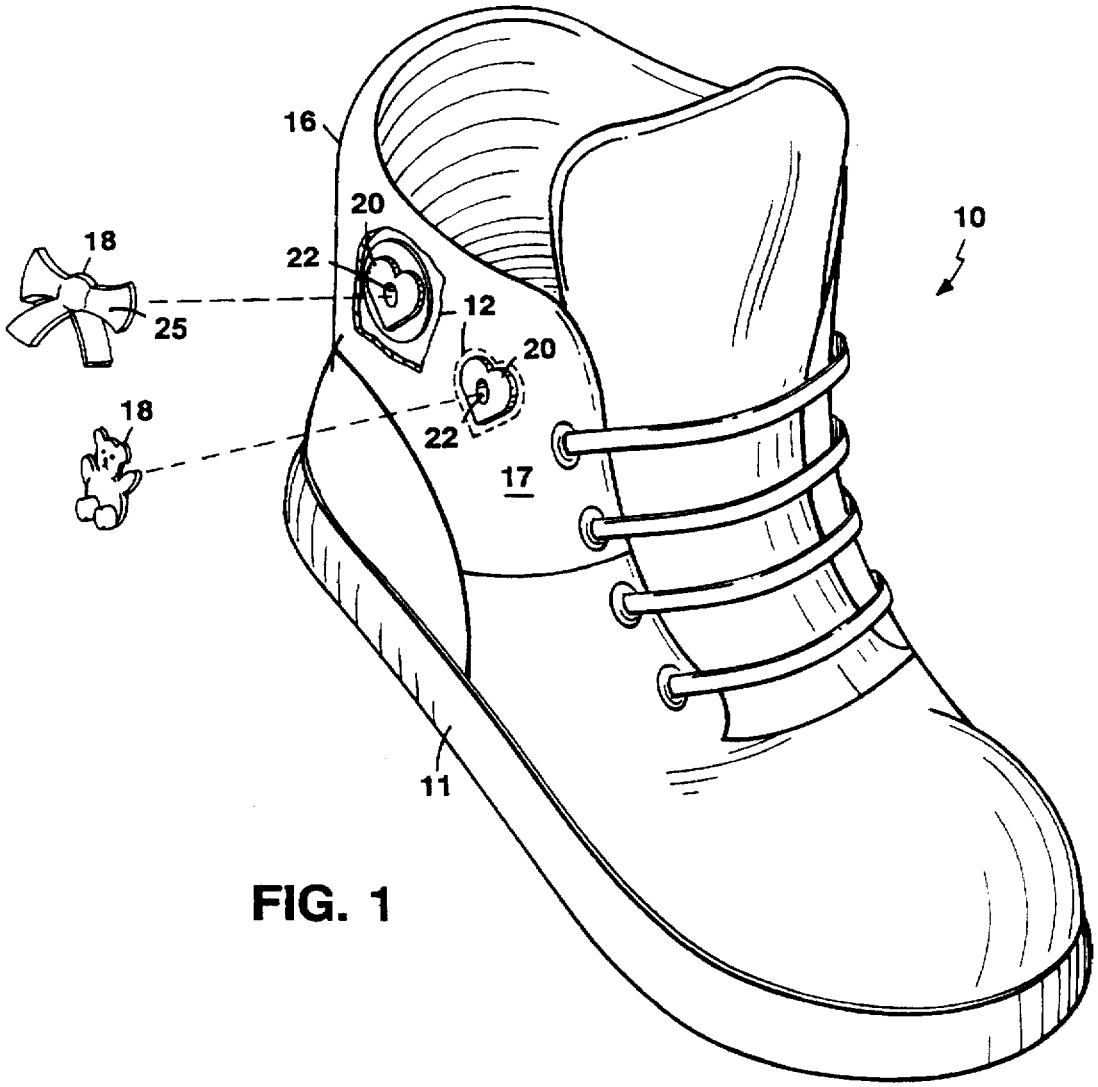
FIG. 1 is a perspective view of a novelty shoe of the invention with a side portion of the upper partially cut-away.

Referring to FIG. 1, a shoe 10 of the invention has a sole 11 and an upper 16, with one or more custom-designed ornamental charms 18 having a primary display surface 25. The charm is removably displayed on the outer surface of the upper, as described below. The shoe upper 16 is preferably canvas or leather, but may be formed of any other suitable material. A female component 12, which provides a base for attachment of the ornamental charms 18, is sewn with a portion extending beneath an outer layer 17 of the upper 16.

Figure 2:
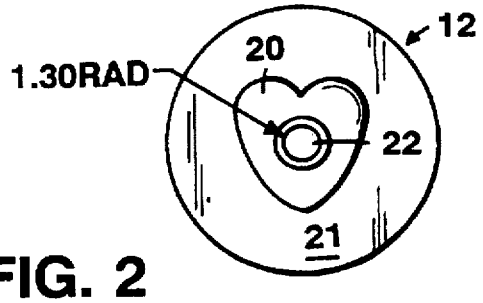
FIG. 2 is a front view of a female component of a snap attachment assembly of FIG. 1.
Figure 3:
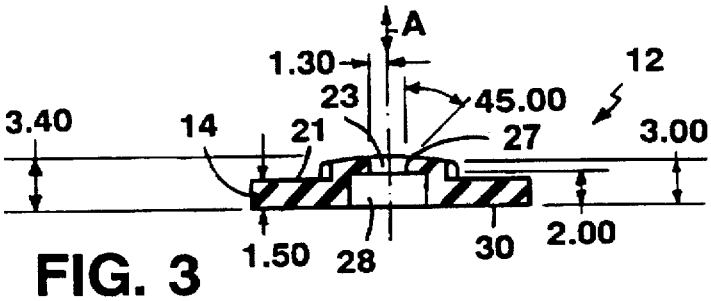
FIG. 3 is a cross-sectional side view of the female component of FIG. 2.
Figure 4:
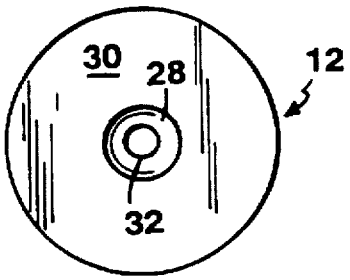
FIG. 4 is a rear view of the female component of the snap attachment assembly of FIG. 1.

Referring now to FIGS. 2–4, female component 12 has a body consisting of a flat circular disk 14 having a predetermined thickness, e.g. 1.50 mm, and formed of a suitable, relatively resilient material, e.g. polyvinyl chloride (PVC) or polypropylene. Extending above an upper surface 21 (FIG. 2) of disk 14 is a secondary display portion display portion 20 having a heart shape exposed within an aperture 19 of complementary shape defined in the outer layer of the shoe upper.

Figure 5:
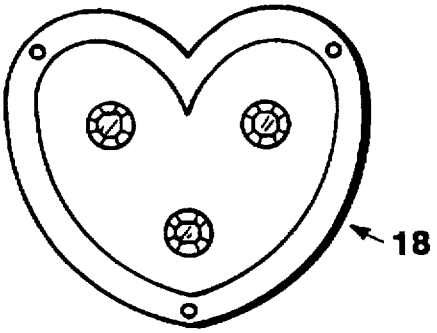
FIG. 5 is a front view of a male component of the snap attachment assembly of FIG. 1.
Figure 6:
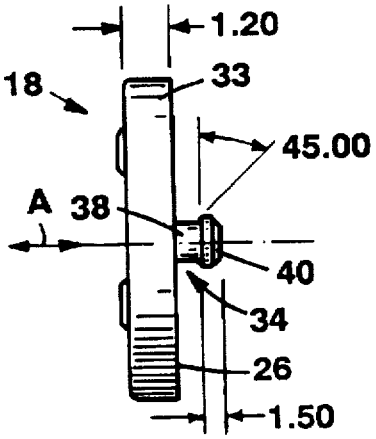
FIG. 6 is a side view of the male component of FIG. 5.

The female component defines a through aperture 22 having a first, upper portion 23 of predetermined diameter, e.g. 2.6 mm, defined by a first encircling edge 27 sized for receiving, in snap-fit engagement, a corresponding member 34 extending from a rear surface 26 of charms 18 (FIGS. 5 and 6). The female component further defines a second, lower portion 28 the aperture, coaxial with upper portion 23, also having a predetermined diameter, e.g. of 6.0 mm, with a depth of about 2.0 mm measured from the bottom surface 30 of the disk. The interface between aperture portions 23 and 28 is defined by a circumferential lip or an encircling second edge 32, with the relatively larger radius of second aperture portion 28 providing flexibility to the lip to allow passage of the extension member 34 upon application of axially applied force (arrow A), while resisting displacement due to transversely applied forces, such as occurs during running and jumping.

Referring to FIGS. 5 and 6, an exemplary one of a variety of charms 18 is shown having a male component 33 in the form of the cantilevered member 34 extending from rear surface 26 of the charm. Cantilevered member 34 is formed of a suitable plastic, e.g. PVC or polypropylene, selected for stiffness similar to or slightly greater than that of disk 14 of the female component. Member 34 has a predetermined diameter approximately that of the through aperture 22, e.g. 2.60 mm, along a neck portion 38 (relatively closer to the base) and a second predetermined diameter, e.g. 3.20 mm, at a distal tip portion 40, the second predetermined diameter being selected to be slightly greater than the diameter of aperture portion 22 to provide an interference fit.

The geometry of the component pieces, and the resilient nature of the materials of fabrication, provide for secure attachment of the charm 18 to the shoe 10. Member 34 is pushed into aperture 22 of female component 12 by application of axially directed force (arrow A) so that distal tip portion 40 stretches aperture 22 until it "snaps" into aperture 28, thereby capturing male component 33 into female component 12.

Figure 7:
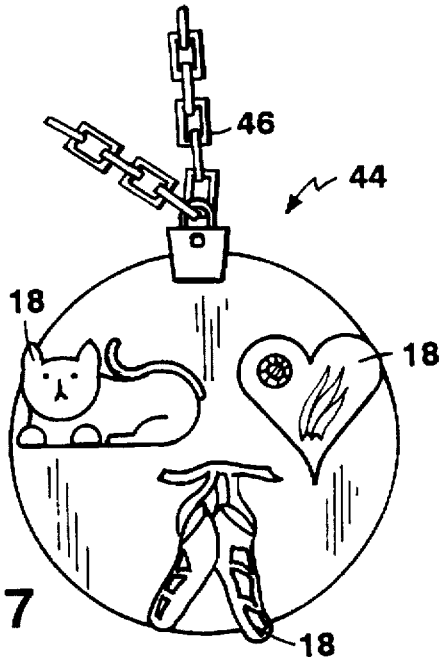
FIG. 7 is a perspective view of a pendant having a snap attachment assembly.

Referring to FIG. 7, a pendant 44 defines a plurality of apertures (not shown), as described above, for receiving decorative charms 18 having corresponding male components. Pendant 44 is shown attached to a chain 46.

Figure 8:
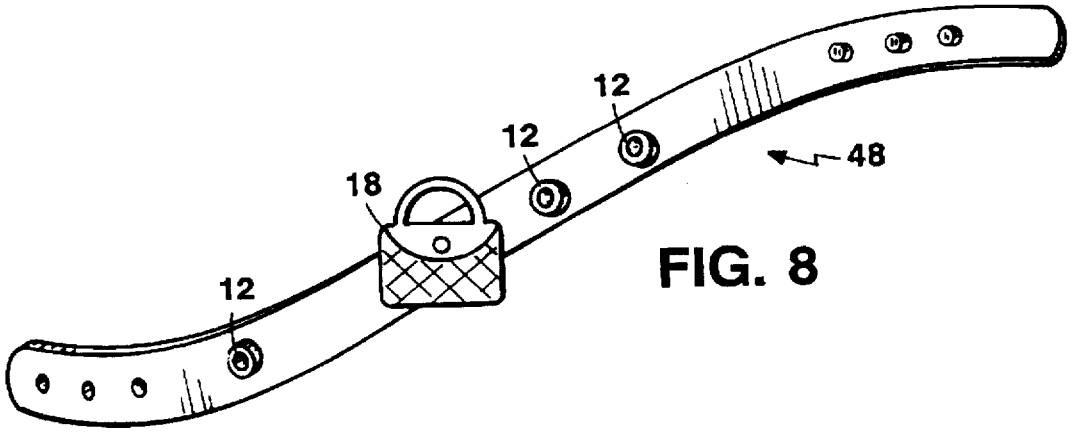
FIG. 8 is a perspective view of a bracelet having a snap attachment assembly.
Figure 9:
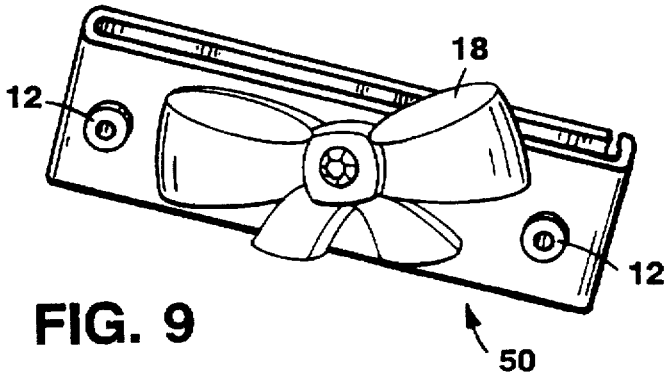
FIG. 9 is a perspective view of a barrette having a snap attachment assembly.

Referring also to FIGS. 8 and 9, a bracelet 48 and barrette 50, respectively, include female components 12, (e.g. molded-in or attached) for receiving charms 18.

Other embodiments are within the scope of the following claims. For example, disc 14 may be any flat shape, and may be attached to shoe 10, e.g., by stitching or adhesive. The female component 12 may also be secured to other parts of shoe 10, including the tongue and rear portions of the upper. The female component may have a body formed of a rigid material, e.g. hard plastic or metal, with a body portion insert of resilient material defining the attachment aperture.

It will also be appreciated that the invention may be employed with any of a variety of types of footwear, including, by way of example only, casual shoes, sandals, sneakers, hiking boots, rain boots and the like.

What is claimed is:

1. Footwear comprising:

a shoe having a sole and an upper mounted on the sole, an ornamental article defining a primary decorative display surface, and a snap attachment assembly for releasable attachment of said ornamental article upon a surface of said shoe, said snap attachment assembly comprising, a female component fixedly secured to said upper of said shoe and defining a secondary decorative display surface exposed when said ornamental article is removed, said female component comprising, a female body portion formed of a resilient material and defining an attachment aperture extending through said female body portion, the resilient material of said female body portion component circumferentially surrounding and defining said attachment aperture defined by a continuous encircling first edge in a region of said secondary decorative display surface and a continuous encircling second edge spaced from said encircling first edge and from said secondary decorative display surface, and an elongated cooperating male component having a male body portion comprising a shaft mounted to extend from a rear surface of said ornamental article and terminating in an enlarged tip portion spaced from said rear surface, said enlarged tip portion of said elongated cooperating male component sized for releasable snap fit engagement with, and disengagement from, said attachment aperture of said female component by application of axially-directed force, said shaft being sized relative to said attachment aperture for a close fit, thereby to resist dislodging radial movement of said male component relative to said female component during movement of the shoe, and said enlarged tip portion being spaced from said rear surface, whereby, upon mounting of said male component upon said female component, with said shaft portion engaged within said attachment aperture, said enlarged tip portion is disposed to at least extend into said encircling second edge, interengagement of said encircling second edge with said enlarged tip portion serving to further resist accidental dislodgement of said male component from said female component.

2. The footwear of claim 1 wherein said upper comprises an outer layer defining a display aperture, and said female body portion of said female component of said snap attachment assembly comprises a disc-shaped member extending beneath said outer layer, with said attachment aperture exposed within said display aperture.

3. The footwear of claim 2 wherein said female component of said snap attachment assembly is secured, with said disc-shaped member extending beneath said outer layer and said attachment aperture exposed within said display aperture, by stitching to said upper.

4. The footwear of claim 2 wherein said secondary decorative display surface of said female component and said display aperture have predetermined complementary shapes.

5. An ornamental article and display assembly comprising:

a shoe including a sole and an upper mounted on the sole, a plurality of ornamental articles each defining a primary decorative display surface, a fashion display accessory, and a snap attachment assembly for releasable attachment of one of said ornamental articles upon a surface of said shoe and fashion display accessory, said snap attachment assembly comprising, a first female component fixedly secured to said upper of said shoe and defining a secondary decorative display surface exposed when one of said ornamental articles is removed, said first female component comprising a first female body portion formed of a resilient material and defining an attachment aperture extending through said first female body portion, the resilient material of said female body portion component circumferentially surrounding and defining said attachment aperture defined by a continuous encircling first edge in a region of said secondary decorative display surface and a continuous encircling second edge spaced from said encircling first edge and from said secondary decorative display surface, a second female component fixedly secured to said fashion display accessory and defining a third display surface exposed when one of said ornamental articles is removed, said second female component having a second female body portion formed of a resilient material and defining an attachment aperture extending through said second female body portion, the resilient material of said female body portion component circumferentially surrounding and defining said attachment aperture, with an encircling third edge in a region of said secondary decorative display surface, and an encircling fourth edge spaced from said encircling third edge and from said secondary decorative display surface, and an elongated cooperating male component having a male body portion comprising a shaft mounted to extend from a rear surface of said ornamental article and terminating in an enlarged tip portion spaced from said rear surface, said enlarged tip portion of said elongated cooperating male component sized for releasable snap fit engagement with, and disengagement from, said attachment aperture of said first and second female components by application of axially-directed force, said shaft being sized relative to said attachment aperture for a close fit, thereby to resist dislodging radial movement of said male component relative to said first and second female components during movement of the shoe, and said enlarged tip portion being spaced from said rear surface, whereby, upon mounting of said male component upon said first and second female components and with said shaft portion engaged within said attachment aperture, said enlarged tip portion is disposed to at least extend into said encircling second and fourth edges of said first and second female components, respectively, interengagement of said encircling second and fourth edges with said enlarged tip portion serving to further resist accidental dislodgement of said male component from said first and second female components, respectively, whereby ornamental articles removably attached to said shoe and to said fashion display accessory by cooperative engagement between said male and first and second female components of said snap attachment assembly are interchangeable.

6. The ornamental article and display assembly of claim 5 wherein said fashion display accessory comprises a pendant and chain.

7. The ornamental article and display assembly of claim 5 wherein said fashion display accessory comprises a barrette.

8. The ornamental article and display assembly of claim 5 wherein said fashion display accessory comprises a bracelet.

9. The ornamental article and display assembly of claim 5 wherein said fashion display accessory defines a plurality of display apertures.

* * * * *